US006022467A

United States Patent [19]

Ilgar

[11] Patent Number: 6,022,467

[45] **Date of Patent: *Feb. 8, 2000**

[54] ELECTROLYTIC TIN PLATING PROCESS WITH REDUCED SLUDGE PRODUCTION

[75] Inventor: Ersan Ilgar, Monroeville, Pa.

[73] Assignee: USX Corporation, Pittsburgh, Pa.

[ * ] Notice: This patent is subject to a terminal disclaimer.

[21] Appl. No.: 09/137,024

[22] Filed: Aug. 20, 1998

Related U.S. Application Data

[63] Continuation-in-part of application No. 08/950,351, Oct. 14, 1997, Pat. No. 5,814,202.

[51] Int. Cl.[7] ..... C25D 5/04

[52] U.S. Cl. ..... 205/140; 205/252; 205/253; 205/300; 205/302

[58] Field of Search ..... 205/140, 252, 205/253, 300, 302

[56] References Cited

U.S. PATENT DOCUMENTS

| | | | |
|---|---|---|---|
| 3,977,949 | 8/1976 | Rosenberg | 204/54 R |
| 4,139,425 | 2/1979 | Eckles et al. | 204/43 S |
| 4,545,870 | 10/1985 | Rosenberg | 204/54 R |
| 4,582,576 | 4/1986 | Opaskar et al. | 204/44.4 |
| 5,814,202 | 9/1998 | Ilgar | 205/140 |

FOREIGN PATENT DOCUMENTS 6346272 12/1994 Japan .

OTHER PUBLICATIONS

Hirsch and Rosenstein, "Tin, Lead, and Tin–Lead Plating" Metal Finishing Guidebook and Directory Issue '96, pp. 289–304, No Month Available.

*Primary Examiner*—Kishor Mayekar
*Attorney, Agent, or Firm*—William L. Krayer

[57] ABSTRACT

Continuous electrolytic tin plating is accomplished in a bath containing 90–160 g/L sulfuric acid, 4–70 g/L tin ion and a grain refiner, and 1–4% nonylphenol ethoxylated with 8–10 ethylene oxide groups, having a weight average molecular weight of 616±18, at a speed of 900–1600 feet per minute and a current density as much as 1500 amperes per square foot or more.

10 Claims, 5 Drawing Sheets

Sludge generation as a function of $H_2SO_4$ concentration at 60 g/L $Sn^{2+}$ and 110°F. Acid concentrations are given in terms of acid added to solution, the measured concentration was approximately 40 g/L higher.

Sludge generation as a function of $Sn^{2+}$ concentration at 126 g/L $H_2SO_4$ (as added) and 110°F.

Plating voltage as a function of $H_2SO_4$ concentration at 30 and 80 g/L $Sn^{2+}$. The measurements were made at 300 and 1000 Amp/ft$^2$ and 110° F.

Sludge generation as a function of $H_2SO_4$ concentration at 60 g/L $Sn^{2+}$ and 110°F. Acid concentrations are given in terms of acid added to solution, the measured concentration was approximately 40 g/L higher.

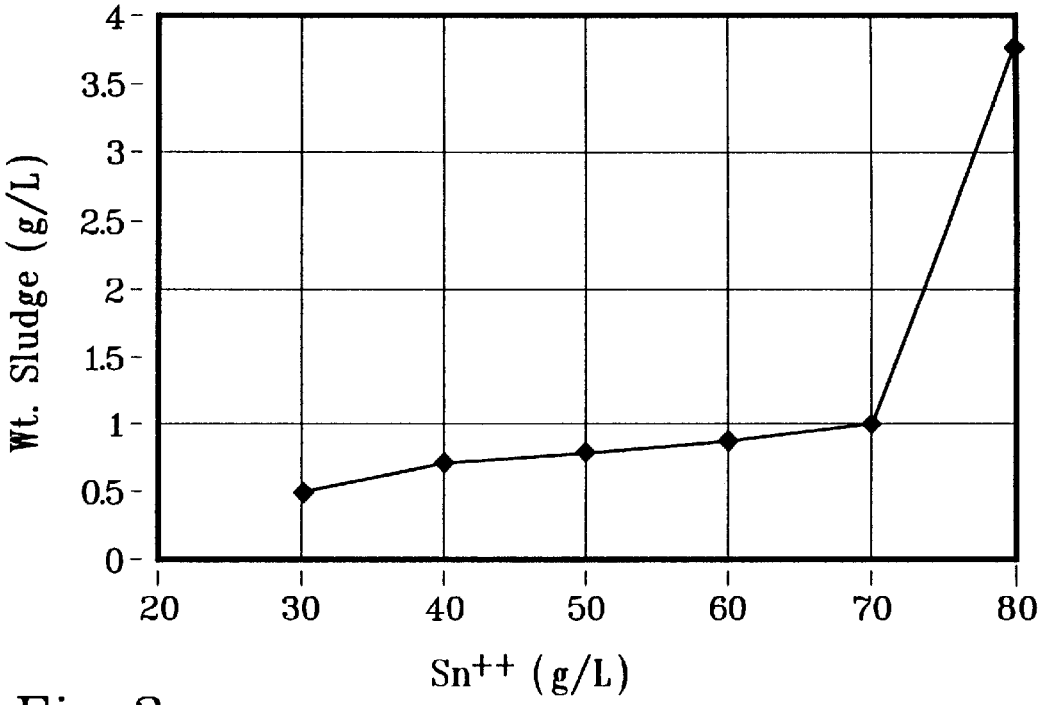
Fig. 3 Sludge generation as a function of $Sn^{2+}$ concentration at 126 g/L $H_2SO_4$ (as added) and 110°F.
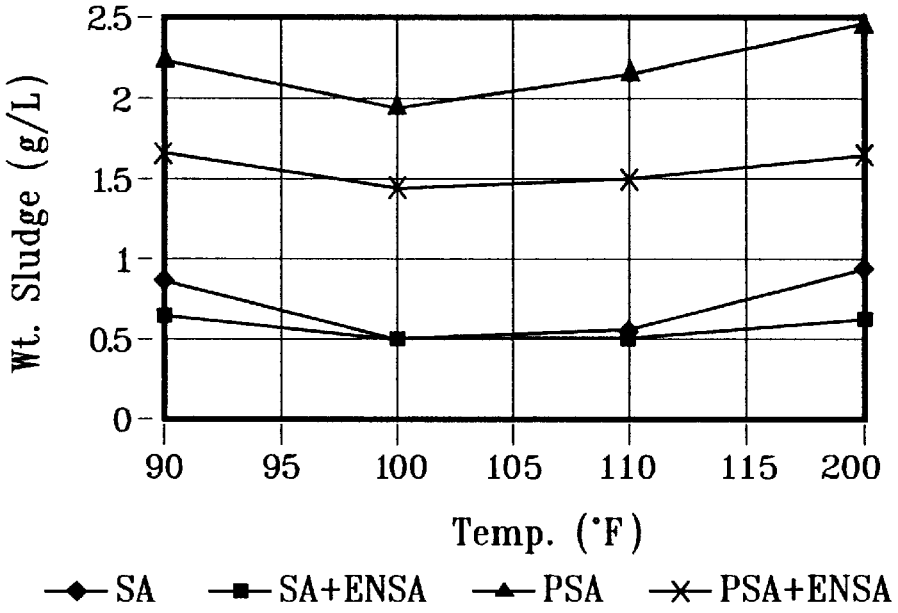
Fig. 4 Sludge generation for PSA and SA electrolytes with and without ENSA grain refiner, as a function of temperature.

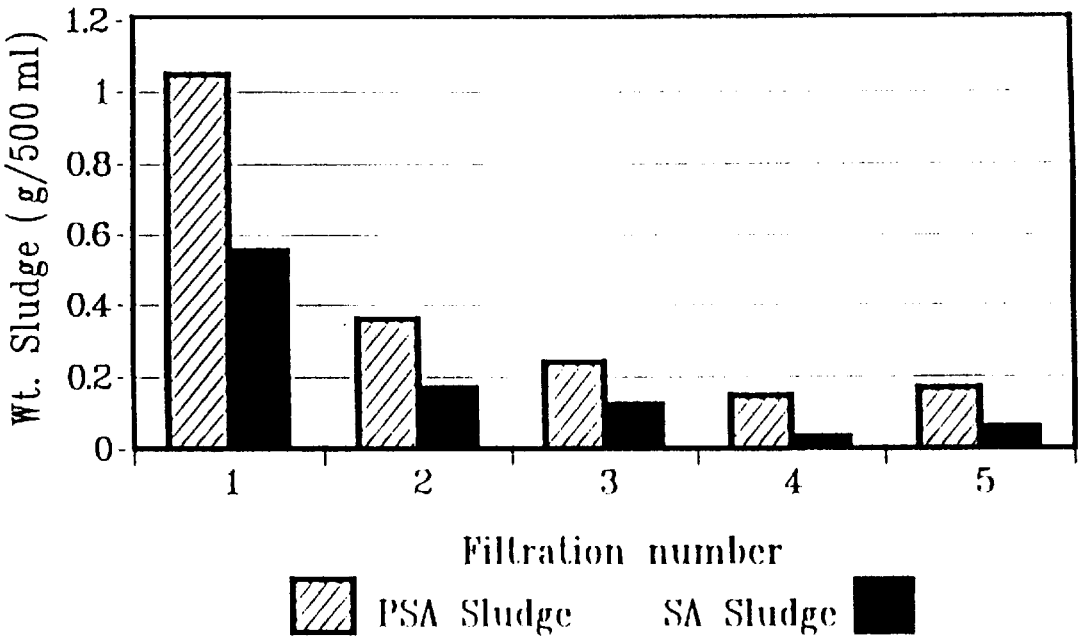
Fig. 5 Sludge generation for PSA and SA electrolytes as a function of periodic filtration under a variety of conditions.
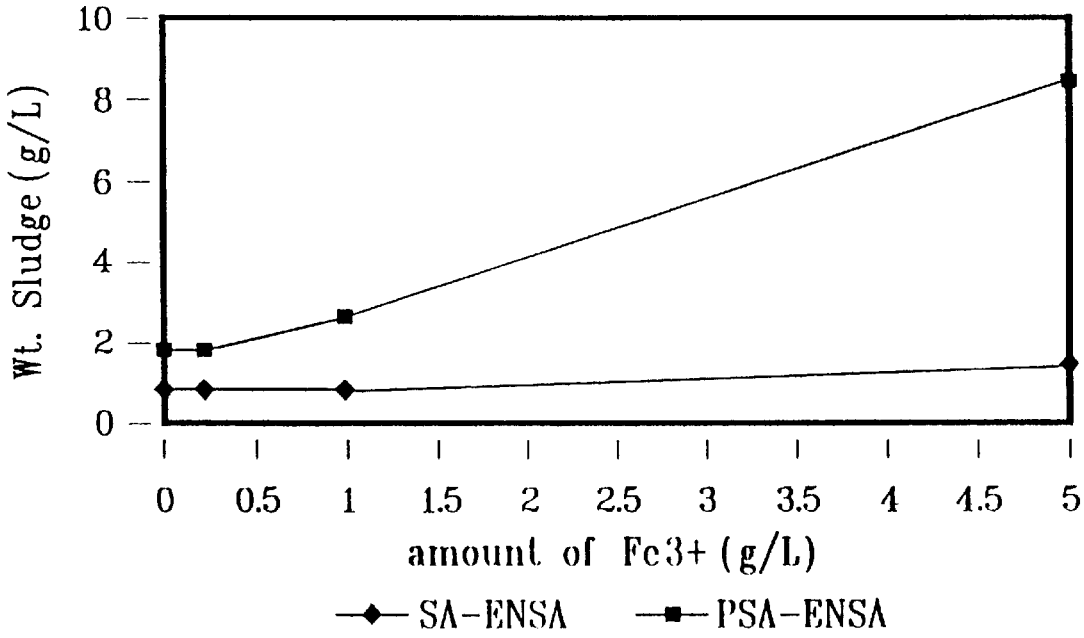
Fig. 6 Ferric ion effect on sludge generation for PSA-ENSA and SA-ENSA electrolytes at 110°F.

ELECTROLYTIC TIN PLATING PROCESS WITH REDUCED SLUDGE PRODUCTION

RELATED APPLICATION

This is a continuation-in-part of my copending application Ser. No. 08/950,351 filed Oct. 14, 1997, now U.S. Pat. No. 5,814,202, for which the benefit of 35USC120 is claimed.

TECHNICAL FIELD

This invention relates to continuous electrolytic tin plating. The process includes a novel set of conditions resulting in the production of significantly less sludge than previous processes. The process is environmentally friendly also in its reduced consumption of power and drastic reduction of waste products containing phenolic groups. Its economic efficiency is realized partly through a significant reduction in capital equipment.

BACKGROUND OF THE INVENTION

Conventional electrolytic tin plating processes for many years have used phenol sulfonic acid (PSA) as the major acidifying constituent of the electrolyte. Being organic and based on phenol, this compound has come under criticism in recent years because of the waste disposal problems it creates. The organic sludge it generates, to a great extent in combination with tin compounds, is complex and contains a high concentration of phenolic compounds generally considered to be undesirable.

In addition, PSA is difficult to analyze in the electrolytic plating line, is toxic, requires a large volume of solution for the plating process, and consumes excessive amounts of power because of its relatively low conductivity.

An acceptable substitute for PSA which eliminates or minimizes the above recited shortcomings would be beneficial to the industry both economically and environmentally.

Electrolytic tin plating requires a source of tin ion and a conductive bath to promote the process of tin deposition. The conductivity of an acid electrolyte for tin plating generally improves with its acidity; tin is conventionally introduced in the form of tin sulfate.

An electrolyte comprising tin sulfate and sulfuric acid in the range of 100–140 g/l has been used for depositing tin on copper wires, foils and other electronic parts to make them solderable, and is described in *Metal Finishing guide Book and Directory Issue,* v. 94, No. 1A, 1996 p 224–297; see Table VIII.

A non-continuous process for depositing bright tin on unspecified substrates apparently for use in the electronics industry is described by Commander and Paneccasio in U.S. Pat. No. 5,061,351 wherein the novel pyridinyl brightening agents are said to be useful through wide ranges of current densities, sulfuric acid concentrations, and metal ion concentrations.

In U.S. Pat. No. 3,860,502, Johnson introduced the use of ethoxylated naphthol sulfonic acid (ENSA) as a brightening agent providing reduced foam and sludge in plating solutions containing 6–30 g/l of free acid (calculated as $H_2SO_4$), which may be added as sulfuric acid—see column 4, lines 27–29. See also JP 6346273, which also uses ENSA and a sludge suppressor such as hydroquinone or resorcinol in a continuous electrolytic tin process, with $H_2SO_4$ concentrations of 5–50 g/l. The authors observe that higher concentrations of sulfuric acid will lead to less sludge formation, but that high sulfuric acid concentrations will cause evolution of hydrogen gas and low tin deposition efficiency due to redissolving of the tin after it is deposited. Accordingly, much of the disclosure of JP 6346273 is devoted to the efficacy of various sludge suppressants used in conjunction with lower concentrations of sulfuric acid, i.e. in the range of 5–50 g/l.

In Japanese Patent Application (Kokai) Hei JP 6-346272, Itatsu and Oyagi disclose a high current density tin plating process which uses a bath containing, as a major component, 5–50 g/L of sulfuric acid, 40–100 g/L of tin (II), brightening agent, and sludge suppressing agent. The deposition is conducted at a current density of 50 A/dm$^2$ "or higher." The authors say that if the concentration of sulfuric acid is higher than 50 g/L, "the dissolution of the steel strip will become serious, so that the iron concentration in the bath will increase."

The presence of iron ions in the bath can be a significant problem, because, in addition to the corrosion of the strip, their generation implies a dissipation of current density to bring about the corrosion of the strip, thus making the process less efficient. High current density has a clear positive correlation to process efficiency. The presence of $Fe^{+3}$ ions in the bath also tends to contribute to the generation of sludge by promoting the oxidation of stannous ions to stannic ions, which form the insoluble hydroxide; the $Fe^{++}$ ions formed in the reaction can easily be oxidized again to $Fe^{+3}$, which again is available for the undesired conversion of the stannous ions to stannic.

Ethoxylated nonylphenols, and "Tergitol NP9" in particular, have been proposed for use in various contexts in tin plating. See Passel's U.S. Pat. No. 3,755,096, for example, which makes brightly tinned objects in an apparently static process wherein the bath essentially includes acrylic acid and a further custom-made "brightener". See also U.S. Pat. No. 2,457,152 by Hoffman, who screened a large number of polyethers for use in tin plating processes—see his general description of the phenolics at col. 10, lines 43–60. However, these workers were not faced with the acute problem of minimizing sludge formation while continuing to produce high quality product.

SUMMARY OF THE INVENTION

My invention is a high speed, high current density process for plating steel strip which utilizes an electrolyte bath of a particular composition under conditions which suppress the generation of sludge.

My invention is a method of continuously tin plating steel strip comprising continuously passing said steel strip through an electrolyte bath. The bath may be contained in one, two, three or more vessels, but the economic benefit of the process is best achieved in one or two vessels. The bath comprises, in an aqueous medium, 90–160 g/L sulfuric acid, 40–70 g/L $Sn^{++}$ and a grain refiner. The strip moves at a speed of 900–1600 feet/min while an electric current an electric current is imposed on the bath at a current density of up to 1500 or even as high as 2000 or more amperes per square foot of steel strip passing through the bath.

In another form, my invention is a method of continuously tin plating steel strip while suppressing the generation of sludge having tin hydroxides as a major component comprising continuously passing the steel strip through an aqueous electrolytic bath at a speed of 900–1600 ft/min while imposing on the aqueous electrolytic bath an electric current at a current density of 200–1500 amperes per square foot of steel strip; the bath comprises 90–160 g/L sulfuric acid and 40–70 g/L $Sn^{++}$ from a source including less than 1% hydroxides of tin. During the process, the pH of the bath is maintained no higher than 0.5 and its temperature between 90–130° F. The strip may then be passed to a rinsing tank.

The process is highly efficient in the suppression of sludge formation, the production rate, the consumption of current, and the minimization of capital equipment.

Unlike many contemporary electrolytic tin processes, my process does not use phenol sulfonic acid (PSA), as the main component of the electrolyte. Rather, it uses sulfuric acid. While sulfuric acid itself is not new as a component of electrolytic tin plating processes, its use is new in my process conditions for tinplate manufacturing and in the concentrations I use, together with the other components of the bath which I employ. The particular balance of sulfuric acid concentration, pH, $Sn^{++}$ concentration, $Fe^{++}$ ions and temperature in the bath with current density imposed on the bath enables a high speed line to operate continuously with minimal generation of sludge, as will be demonstrated in the descriptions below.

BRIEF DESCRIPTION OF THE DRAWINGS

FIG. 3 shows sludge generation as a function of $Sn^{++}$ concentration at 126 g/L $H_2SO_4$ and 110° F.

FIG. 4 graphically compares sludge generation for PSA and sulfuric acid (SA) electrolyte with and without ENSA grain refiner, as a function of temperature.

FIG. 5 compares sludge collection by filtration from PSA and SA electrolyte under a variety of conditions.

FIG. 6 is a graph of the effect of ferric ion on sludge generation in my sulfuric acid electrolyte and the conventional PSA electrolyte, both with ENSA grain refiner.

DETAILED DESCRIPTION OF THE INVENTION

My invention is based on the results of various experiments which will be explained below.

Sulfuric acid was selected as the basic acid for the electrolyte because (a) it is a simple inorganic, adding no phenolic or other organic radicals to the bath, (b) its effect on pH is highly efficient, realizing a low sludge formation rate, and (c) its effect on conductivity is highly beneficial to the process.

The optimum range of concentration of sulfuric acid was chosen taking into account the conductivity of the solution and the overall sludge production of the solution.

Effect of Sulfuric Acid Concentration on Conductivity

Figure 1A:
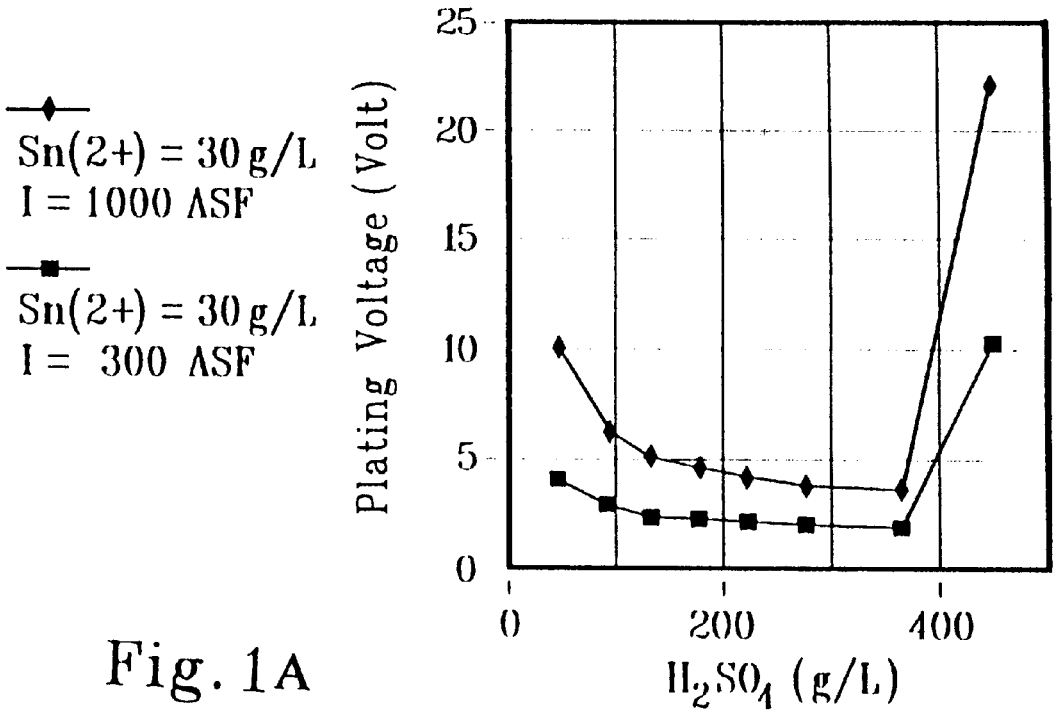
FIGS. 1A and B show two graphs of plating voltage as a function of $H_2SO_4$ concentration, taken with two different concentrations of $Sn^{++}$; measurements were made at 300 and 1000 Amp/ft$^2$ and 110° F.
Figure 1B:
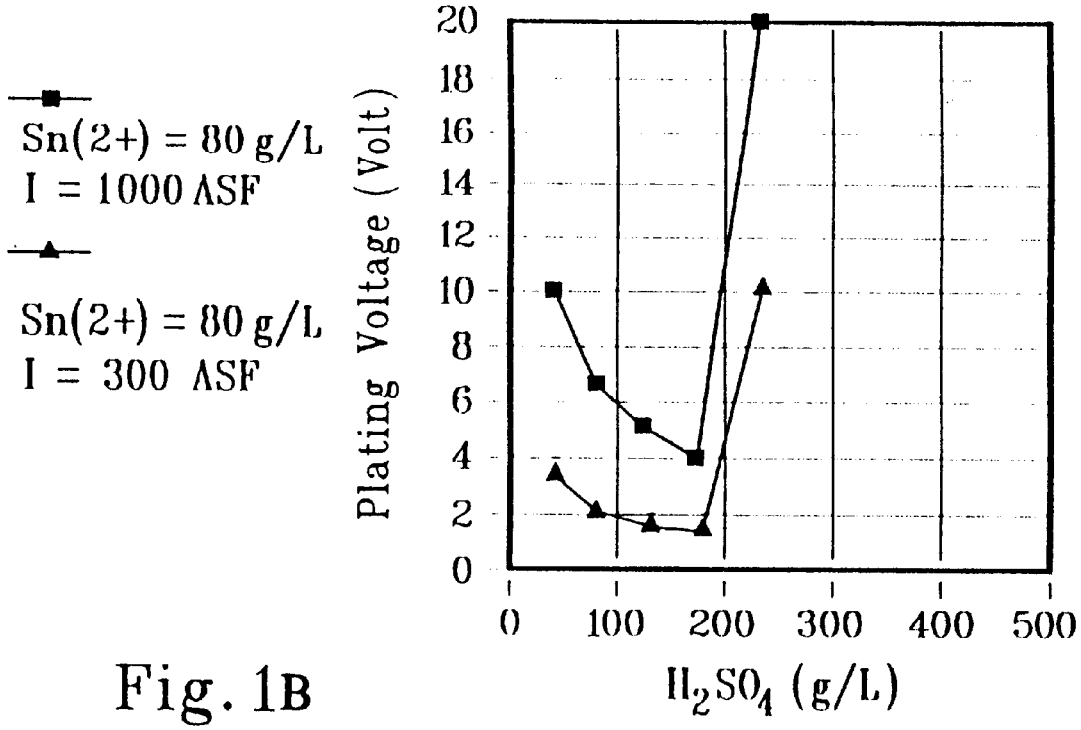

Plating power consumption is the product of volts and amperes and is affected by the conductivity of the electrolyte. When the conductivity is increased, the voltage decreases for a given applied amperage, and consequently the power consumption decreases. Experiments measuring the plating voltage as a function of sulfuric acid concentration at two different concentrations of $Sn^{++}$ are summarized in FIG. 1. The data were gathered at 110° F. The results show that the sulfuric acid electrolyte containing stannous ion provides excellent conductivity in the range 90–160 g/L. Above 180 g/L there is a significant risk of increased power consumption due to the passivation of tin anodes, and higher viscosity of the electrolyte, which lowers the mobility of ions responsible for transferring the current in the solution.

Effect of Sulfuric Acid Bath on Sludge Generation

All of the conventional commercially used tin plating processes generate sludge. The sludge is classified as a hazardous waste, particularly if it contains phenol, as is the case with sludge generated by PSA-based electrolytes, or cyanide, as in the case of the halogen systems. Disposal is difficult and costly. In addition, sludge can produce scratches, nodules, "pick-up", and stains on the product, and can block nozzles, pumps and other circulation equipment.

Figure 2:
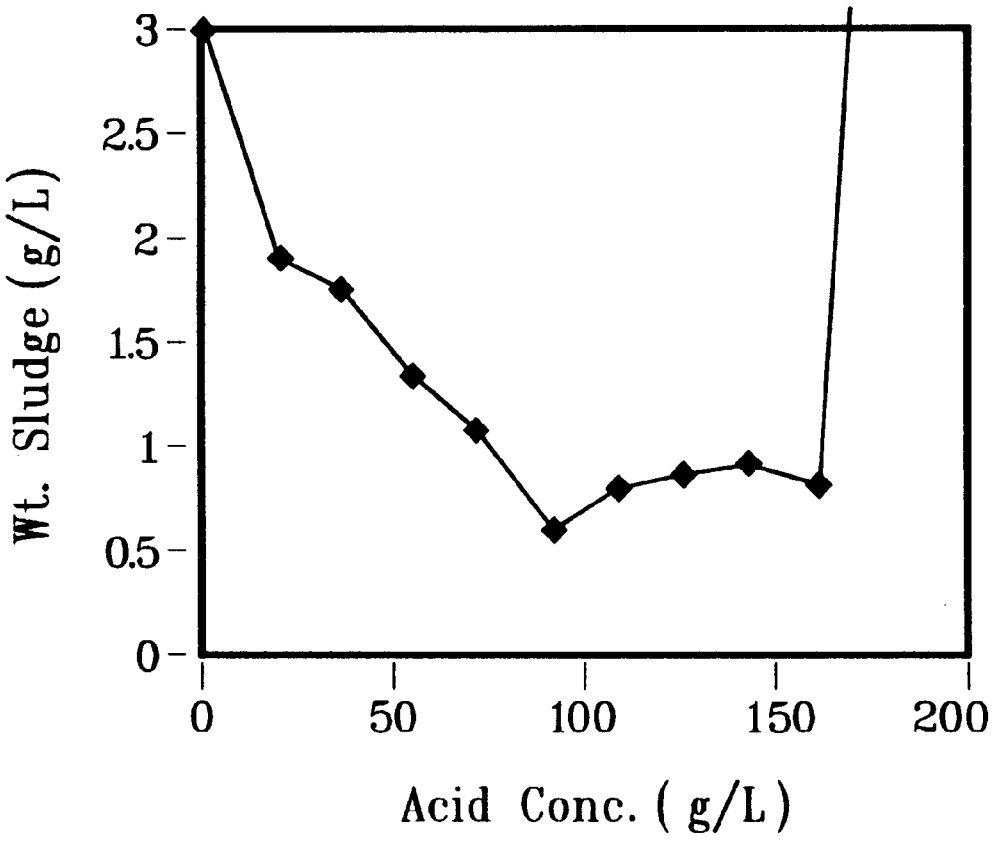
FIG. 2 shows sludge generation as a function of $H_2SO_4$ concentration, with 60 g/L $Sn^{++}$ and 110° F.

Using an electrolyte containing 60 g/L $Sn^{++}$ and 3 g/L ENSA at 110° F., solutions were prepared containing 0, 18, 36, 54, 72, 90, 108, 126, 144, 162, 216 and 234 g/L of $H_2SO_4$ and maintained in vessels in a water bath at 110° F. for 24 hours. Solutions were then filtered through filter paper, the filter paper was rinsed on the outside to remove absorbed sulfuric acid, and upon drying the filter paper was re-weighed to determine the dry weight of the sludge. Results in FIG. 2 show that the generation of sludge declines steadily as a function of sulfuric acid concentration, reaching a minimum at about 90 g/L and increasing rapidly beginning about 162 g/L; solubility of the sludge products appears to decrease as the concentration of free sulfuric acid increases. The results shown in FIG. 2 were confirmed by similar experiments using solutions of sulfuric acid at different concentrations. The upper limit of sulfuric acid concentration, based on these experiments, was determined to be 160 g/L; the optimum was determined to be 130 g/L ±10 g/L.

Relation of $Sn^{++}$ Concentration to Current Density

A relatively high concentration of tin ions in an operation conducted at high current density will enable good production rates in an economically efficient plant. Operation at high current density is desirable for reducing the amount of solution, plating tanks, rolls, other equipment, and for maintenance of the plating line. Conventionally as many as 12 tanks may be used, and many commercial tinning lines use from 5 to 12 tanks of electrolyte. The use of relatively high concentrations of tin ions allows for better diffusion of the ions to the surface of the fast-traveling strip, and enables the economically efficient high current density to produce consistently good product.

Effect of $Sn^{++}$ Concentration on Sludge Generation

To evaluate the effect of tin concentration on sludge generation, an experiment was conducted in six 500 ml sulfuric acid solutions containing 130 g/L of $H_2SO_4$. Tin sulfate was then added to the solutions to give concentrations of $Sn_{++}$ of 30, 40, 50, 60, 70, and 80 g/L. The solutions (in vessels) were then placed in a water bath at 110° F. and allowed to stand for 24 hours. They were then filtered through weighed filter paper and the filter paper was rinsed on the outside to remove absorbed sulfuric acid. Upon drying, the filter paper was re-weighed to determine the dry weight of the sludge. The results of the experiment are reported in FIG. 3. Sludge generation increased only slightly between 30 and 70 g/L $Sn^{++}$, and then, above 70 g/L, a drastic increase was observed. It was speculated that the solutions above 70 g/L may not have been able to dissolve the tin sulfate. While concentrations of stannous ion in the range of 30–70 g/L are operable, I prefer to use 40–60 g/L, with a target of 50 g/L.

Comparison of Sludging due to Oxidation

A series of experiments was devised to estimate the effect of atmospheric oxidation on the proposed $H_2SO_4/Sn^{++}$ solution as compared to a conventional PSA electrolyte at temperatures ranging from 90 to 120° F. First, four solutions were made containing (a) 130 g/L sulfuric acid and 60 g/L $Sn^{++}$ with 3 g/L ENSA and (b) without ENSA, (c) 60 g/L PSA and 30 g/L $Sn^{++}$ with 3 g/L ENSA and (d) without ENSA. The four solutions, 500 mL each, were maintained at equal conditions for each run (temperatures held constant in a water bath at pressures of about 7 psi) and sparged with oxygen for four hours. After four hours of sparging, the sludge that had formed was collected by filtration through a weighed filter paper, and, upon drying the paper, the filter paper was re-weighed to determine the dry weight of the sludge produced by each of the four solutions. The results are shown in FIG. 4, from which it may be seen that the sulfuric acid electrolyte produces less sludge with and without the ENSA additive. It may be seen also that sludging tends to increase above 110° F. for all systems tested and accordingly, although my process is operable between 90 and 130° F., I prefer to conduct it at temperatures between 100 and 110° F. Note that ENSA's beneficial effects in the sulfuric acid electrolyte are most noticeable when temperatures stray to levels above and below the preferred range.

Antioxidants are known to be of benefit in electrolytic baths used for continuous tinplating, and many readily available antioxidants are useful in or at least compatible with my process. Antioxidants which may be used in effective amounts in my invention include tartaric acid, ammonium potassium tartrate, sodium tartrate, potassium sodium tartrate, hydroxylamine hydrochloride, resorcinal, p-nitrophensene, amino antipyrine, cerve ammonium nitrate, d-gluconic acid, N-propyl gallate, diphenyl amine sulfamic acid, hydroquinone, and pyrogallic acid. These and other antioxidants are effective in various amounts to various degrees to inhibit the oxidation of $Sn^{++}$ to $Sn^{++++}$.

The Effect of pH on Sludge Formation

Atmospheric oxidation is a major source of sludge generation under actual operating conditions. The reaction taking place due to the presence of dissolved oxygen is $$\frac{1}{2}O_2 + 2H^+ + Sn^{++} \rightarrow Sn^{4+} + H_2O \quad \Delta G^\circ = -49 \text{ kcal} \qquad \text{(Eq. 1)}$$

$$Sn^{++} + 2H_2O \rightarrow Sn(OH)_2 + 2H^+ \quad K_h = 2\times10^{-3} \qquad \text{(Eq. 2)}$$

$$Sn^{4+} + 2H_2O \rightarrow Sn(OH)_4 + 2H^+ \quad K_h = 10 \qquad \text{(Eq. 3)}$$

The negative free energy ($\Delta G^\circ$) value seen in equation 1 indicates that the reaction will go to the right in the presence of an oxidant, thus forming unstable $Sn^{4+}$ which further hydrolyzes and forms an insoluble $Sn(OH)_4$. The insoluble hydroxides eventually precipitate out and are seen as sludge. The $Sn^{++}$ can also be hydrolyzed to produce the insoluble $Sn(OH)_2$. However, the $K_h$ (hydrolysis constant) for stannic ions (10) is about 5000 times higher than that of stannous ions ($2*10^{-3}$), meaning the formation of $Sn(OH)_4$ is much more favorable than $Sn(OH)_2$ as seen in equations 1–3.

It is believed that the difference in pH accounts for the difference in sludging results which may be seen in FIG. 5. For this study, 500 ml solutions of PSA (with 30 g/L $Sn^{++}$) and sulfuric acid (with 60 g/L $Sn^{++}$) and the sludge formed was collected through a series of five filtrations, with the filtrate from the previous filtration being used as the solution for the next. The first sludge filtration was performed after three hours of oxygen sparging in a 110° F. water bath, the next three were performed after 24 hour intervals in a water bath at 110° F. with no oxygen sparging, and the final filtration was performed after 48 hours at ambient temperature with no oxygen sparging. The sludges were collected by filtration through weighed filter paper and upon drying the dry weight of the sludge was determined. The PSA electrolyte consistently produced at least twice as much sludge as the sulfuric acid electrolyte. Furthermore, the PSA electrolyte continued to produce a significant amount of sludge after several filtrations, whereas the sludge produced by the sulfluric acid electrolyte dropped to approximately zero after three filtrations, with the majority seen in the figure for the last two filtrations due to $H_2SO_4$ absorbed in the filter paper.

Contribution of Ferric Ions to the Sludging Process

Iron may enter the electrolyte in a commercial facility from dissolution of the strip in the plating solution and from drag-out from the pickling process.

Equation 4 is the basis for the following discussion.

$$2Fe^{3+}+Sn^{++}\rightarrow Sn^{4+}+2Fe^{++}\Delta G^\circ=-28.5\text{Kcal} \qquad \text{(Eq. 4)}$$

The reaction produces results similar to atmospheric oxidation, due to the same mechanism of transformation of more stable stannous ions to the less stable stannic state. Once the stannic ions are generated, the reaction that produces sludge is identical to the one described above for atmospheric sludge generation. To further complicate the problem, the $Fe^{++}$ ions generated may be oxidized in a second oxidation reaction by dissolved oxygen and/or anodically during application of electrolysis conditions to become $Fe^{3+}$ ions again. Therefore, this oxidation/reduction reaction becomes cyclic and consequently, significant amounts of sludge can be generated in this manner. Ferric ions can also be a problem because they tend to lower the current efficiency of the process by stealing the cathodic current and/or corroding the tinplate in the solution.

$$Fe^{+++} + \grave{e} = Fe^{++} \text{ (cathodic reduction)} \quad \Delta G^\circ = -35.5 \text{ Kcal} \qquad \text{(Eq 5)}$$

$$2Fe^{+++} + Sn^\circ \text{ (tinplate)} = 2Fe^{++} + Sn^{++} \text{ (corrosion of tinplate)}; \quad \Delta G^\circ = -41.9 \text{ Kcal} \qquad \text{(Eq 6)}$$

To investigate the effect of the presence of iron in the electrolyte, four solutions were prepared to compare the sulfuric acid electrolyte to a PSA electrolyte as in the previous experiment. Ferric ions (as ferric sulfate) were added to aliquats of the solutions in concentrations of 0.0, 0.2, 1.0, and 5.0 g/L $Fe^{+++}$ for each of the two types of electrolytes. Once the solutions were prepared, they were maintained under equal conditions, and were sparged with oxygen for 4 hours to simulate the oxidation which might take place in a commercial facility. Throughout the experiments, the pressure was maintained at about 7 psi, and the temperature was held constant at 110° F. in a water bath. After the four hour sparging, the sludge that had formed was collected by filtration through a weighed filter paper. Upon drying the filter paper, it was re-weighed to determine the dry weight of the sludge produced by each of the four types of solution. The results may be seen in FIG. 6. Both types of solution demonstrated a tendency toward increasing amounts of sludge with increasing iron content. However, the conventional PSA electrolyte showed a much greater increase in sludge generation as the ferric ions are added than the sulfuric acid electrolyte. These results are consistent with the discussion of the theory of tin hydrolysis above and its relation to the pH of the solution. They are also consistent with the other sludge generation results comparing PSA and sulfuric acid, in that the sulfuric acid solutions produced less sludge.

Effect of the Condition of the Tin Source

It is known that, because of internal redox reactions and a residue of acid moisture, commercial tin sulfate tends to discolor and degrade when held at around 60° C. (140° F.). Such temperatures are not uncommon in steel mills and electrolytic tin plating mills. I have speculated that even at temperatures lower than 140° F., a slow degradation may take place in the solid state of the $SnSO_4$ over time under various types of storage conditions. Accordingly, an experiment was devised to test sludging with filtered and unfiltered tin sulfate solutions.

The first test was conducted by first preparing three sulfuric acid electrolyte solutions differing only in the source of tin sulfate. The solutions, each containing 110 g/L $SnSO_4$, were maintained under equal conditions and were sparged with oxygen for 4 hours to simulate oxidation. Throughout the experiments, the pressure was maintained at about 7 psi and the temperature was held constant at 110° in a water bath. After the four hour sparging, the sludge that had formed was collected by filtration through a weighed filter paper, and upon drying the paper, the filter paper was re-weighed to determine the dry weight of the sludge produced by each of the three solutions. The results are seen in Table 1, which shows a definite relationship between the age of the tin sulfate and the amount of sludge formed.

TABLE 1

| Tin Sulfate Source | Wt. Sludge (g/L) |
|---|---|
| New Fisher $SnSO_4$ | 0.5 |
| Atotech Commercial $SnSO_4$ | 1 |
| Aged Fisher $SnSO_4$ | 46 |

In another test, a one liter solution of sulfuric acid and 110 g/L tin sulfate was split into two equal 500 ml portions. One of the portions was then filtered immediately and the other was left untouched. After the filtration was completed, both solutions were maintained under equal conditions and were sparged with oxygen for 4 hours to also simulate oxidation. Throughout the experiments the pressure was maintained at about 7 psi and the temperature was held constant at 110° in a water bath. After the four hour sparging, the sludge that had formed was collected by filtration through a weighed filter paper. Upon drying the paper, the filter paper was re-weighed to determine the dry weight of the sludge produced by each of the four solutions.

As seen in Table 2, the results of this test are that the pre-filtered solution contained very little sludge compared to the one that was not filtered.

TABLE 2

| Source | Wt. Sludge (g/L) |
|---|---|
| Old Atotech $SnSO_4$ (filtered) | 0.18 |
| Old Atotech $SnSO_4$ (not filtered) | 1.3 |

This shows, as was seen before, that the sludge, or a major portion of it, must have already been present in the tin sulfate before the solution was made. It should be understood that once the sludge is made or is present in the electrolyte, it cannot by present technology be conveniently re-dissolved. Also note that the PSA contains less tin sulfate than the sulfuric acid solution; therefore it should generate less sludge, meaning that the experiments above comparing PSA electrolyte with sulfuric acid electrolyte should be reviewed with the understanding that the sulfuric acid electrolyte may have begun the experiment with an absolute quantity of sludge present significant greater than the amount of sludge initially present in the PSA solutions. In any event, one aspect of my invention involves the filtration of the tin sulfate solution before adding it to the electrolyte.

Grain Refiners

It is known that the addition of surfactants to an electrolyte in an electrolytic deposition process can affect the nucleation process during electrocrystallization, and thereby affect the nature and appearance of the final coated surface. The mechanism of the interreaction of the surfactant is complex and there is not complete agreement in the art as to its specifics, but the prevailing view is that the organic surfactant absorbs on the fast growing sides of the crystals, preventing or inhibiting dendritic powdery growth and promoting nucleation, leading to a more prolific nucleation and a final product which is smooth and compact. One absorbed organic molecule may affect many metal ions, and therefore the effects of even a small amount of surfactant are readily manifested.

Generally any of the known grain refiners is compatible with my invention. I prefer to use nonionics; some of the more useful types are the ethoxylated nonionics such as ethylene oxide adducts of alkylated phenols (Triton X-114, Triton X-100, Tergitol NPX, Tergitol NP35, Tergitol NP-33, Tergitol TP-9, ENSA-6, Priminox T-25, Propomeen C/12, and bisphenol A. Aliphatic alcohols such as Surfonic TD-90 and Surfonic TD-150 may also be used, as may alkylated mercaptans such as Tergitol 12-M-6, Tergitol 112-M-8.5, and Tergitol 12-M-10.

I prefer to use as a grain refiner Tergitol TP-9 or Tergitol NP-33, in a concentration of 1–4 g/L.

To demonstrate the invention, black plate panels (8 inch by 2.5 inch) were electrolytically cleaned in an alkaline cleaner at 180° F., then rinsed with warm water, dip pickled in 10 percent $H_2SO_4$, rinsed with warm water and placed immediately into a circulation cell for plating. The circulation cell simulates the commercial line conditions by pumping the solution at 100 to 1000 feet/minute between a rectangular cathode (black plate) and anode (tin). Twenty-four liters of solution (75 g/L sulfuric acid; 60 f/L $Sn^{++}$, hereafter referred to as sulfuric acid electrolyte) stored in a reservoir was continuously pumped through the cell between parallel electrodes (anode-cathode), where the application of current plates tin from the solution (sulfuric acid electrolyte) at a gap of one inch (2.54 cm). The solution is heated in the reservoir and the desired operating temperature is kept constant.

After plating was completed, the matte tinplate samples were rinsed with warm water and dried. To produce melted tinplate products, the matte tinplate panels were melted by AC-resistance heating and quenched in hot water (150° F.) for a preset time. Evaluation of the tinplate samples was made by visually examining the surface of the panels. The product was rated acceptable if the panels showed a noticeably lustrous appearance.

The grain structure of the No. 25 unmelted tinplate panels obtained from the sulfuric acid electrolyte in the presence of "Triton X-100" and in the presence of "Tergitol NP-9" were compared to ones obtained from the currently commercially used PSA electrolyte, which were used as control panels. Scanning electron micrographs of the No. 25 tinplate surfaces obtained from the sulfuric acid electrolyte in the presence of each additive were obtained. The structure of the unmelted sulfuric acid electrolyte tinplates in the presence of these additives at various current densities were similar to that of PSA tinplate samples. X-ray diffraction patterns of the unmelted tinplate obtained at various current densities in the presence of these two additives were compared to that of PSA tinplate. It appeared that "Tergitol NP9" produced tin crystal orientation most similar to one made from the PSA system under normal conditions.

Alloy morphologies for the K-plate (NO. 100) obtained in the sulfuric acid electrolyte system in the presence of each additive were also compared to a normal alloy structure from the PSA control panels. The continuity (porosity) of the alloy layer was studied by SEM. It appeared that sulfuric acid tinplate with "Tergitol NP9" has a structure similar to that made by the PSA system.

Figure 7:
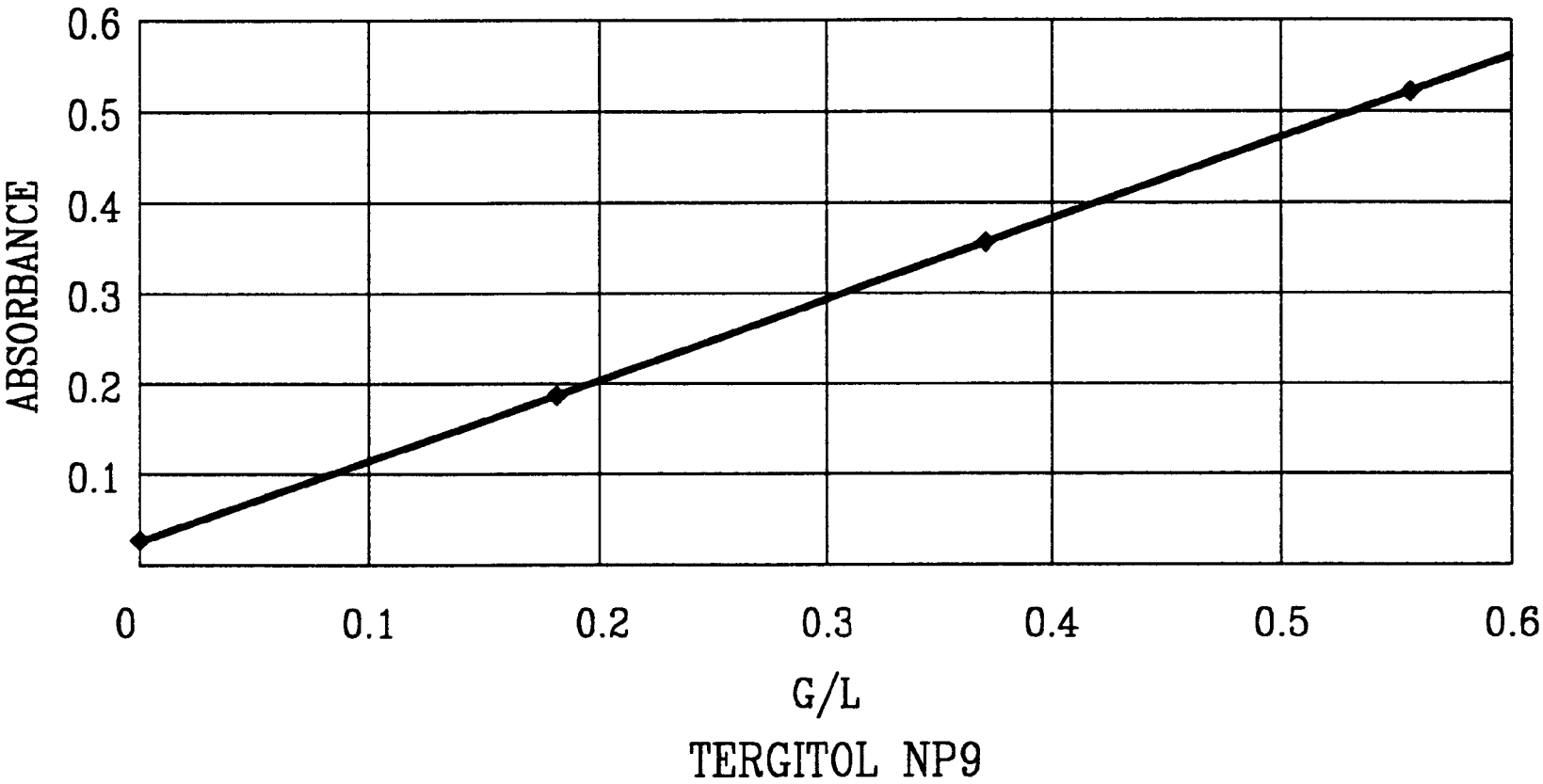
FIG. 7 is a calibration curve of UV absorbance as a function of grain refiner concentration.

The sulfuric acid electrolyte solutions in the presence of each additive were also evaluated for their analyzability. A UV spectrometer was used for the analysis of the surfactants in the sulfuric acid solution. A calibration curve for the preferred additive, nonylphenol ethoxylated with nine ethylene oxide groups ("Tergitol NP9"), is shown in FIG. 7. An unknown concentration of the preferred additive in a given sulfuric acid electrolyte will exhibit an absorbance in the spectrometer, which then correlates to the concentration of the surfactant in the sulfuric acid bath. The additive can be easily analyzed by UV spectroscopy. A calibration curve for a standard solution was developed, i.e. as seen in FIG. 7, the amount of the preferred additive (as defined above) readily correlates with the UV absorbance.

The quality of tinplate obtained using a bath containing 1–4% of the preferred ethoxylated nonylphenol additive as defined above is at least equal to that obtained using the conventional PSA electrolyte, while minimizing sludge formation.

Thus, my preferred invention is a method of continuously tin plating steel strip comprising continuously passing the steel strip through an electrolyte bath comprising, in an aqueous medium, 90–160 g/L sulfuric acid, 40–70 g/L $Sn^{++}$ and 1–4 g/L of a nonylphenol ethoxylated with 8–10 ethylene oxide groups, having a weight average molecular weight of 616±18, at a speed of 900–1600 feet/min while imposing on said bath an electric current at a current density of 200 to 2000 amperes per square foot of steel strip passing through said bath and maintaining the temperature of said bath between 90° F. and 130° F. In a preferred version of the invention, the current density is about 500–1500 amperes per square foot of steel strip passing through the vessel(s).

I claim:

1. Method of continuously tin plating steel strip comprising continuously passing said steel strip through an electrolyte bath comprising, in an aqueous medium, 90–160 g/L sulfuric acid, 40–70 g/L $Sn^{++}$ and 1–4 g/L of a nonylphenol ethoxylated with 8–10 ethylene oxide groups, having a weight average molecular weight of 616±18, at a speed of 900–1600 feet/min while imposing on said bath an electric current at a current density of 200 to 2000 amperes per square foot of steel strip passing through said bath and maintaining the temperature of said bath between 90° F. and 130° F.

2. Method of claim 1 wherein said bath also includes an amount of antioxidant effective to inhibit the oxidation of $Sn^{++}$ to $Sn^{+4}$.

3. Method of claim 1 wherein said bath is present in one or two vessels.

4. Method of claim 1 wherein said bath has a pH no higher than 0.5.

5. Method of claim 1 wherein said bath generates no more than about 1 g/L sludge over a period of two weeks.

6. Method of claim 1 followed by passing said strip to a rinsing tank.

7. Method of claim 1 wherein said electrolyte bath includes an $Fe^{++}$ concentration between 1 and 20 grams/liter.

8. Method of claim 1 wherein the $Sn^{++}$ is introduced to the bath from a solution of tin sulfate which has been filtered.

9. Method of claim 1 wherein the current density is about 500 to about 1500 amperes per square foot of steel strip passing through said vessels.

10. Method of claim 1 wherein said nonylphenol is nonylphenol ethoxylated with nine ethylene oxide groups and has an average molecular weight of 616.

* * * * *